US011298741B2

(12) United States Patent
Huang

(10) Patent No.: US 11,298,741 B2
(45) Date of Patent: Apr. 12, 2022

(54) CHAIN REPLACEMENT APPARATUS

(71) Applicant: POUL CHANG METAL INDUSTRY CO., LTD., Taichung (TW)

(72) Inventor: Chia-Hao Huang, Taichung (TW)

(73) Assignee: POUL CHANG METAL INDUSTRY CO., LTD., Taichung (TW)

( * ) Notice: Subject to any disclaimer, the term of this patent is extended or adjusted under 35 U.S.C. 154(b) by 337 days.

(21) Appl. No.: 16/700,374

(22) Filed: Dec. 2, 2019

(65) Prior Publication Data

US 2021/0162488 A1 Jun. 3, 2021

(51) Int. Cl.

| | |
|---|---|
| ***B21L 9/06*** | (2006.01) |
| ***B21L 21/00*** | (2006.01) |
| ***B21L 19/00*** | (2006.01) |

(52) U.S. Cl.

CPC ..... *B21L 9/065* (2013.01); *B21L 19/00* (2013.01); *B21L 21/00* (2013.01); *Y10S 59/00* (2013.01)

(58) Field of Classification Search

CPC .. B21L 9/065; B21L 21/00; B23P 6/00; B23P 19/04; B25B 27/00; B25B 27/02–023; B21J 15/14; Y10S 59/00

See application file for complete search history.

(56) References Cited

U.S. PATENT DOCUMENTS

| | | | | |
|---|---|---|---|---|
| 2,826,893 | A * | 3/1958 | Falk | B21L 9/00 59/7 |
| 4,581,825 | A * | 4/1986 | Parton | B21L 9/04 30/358 |
| 5,140,736 | A * | 8/1992 | Hsiao | B25B 27/0071 29/243.54 |
| 7,254,935 | B1 * | 8/2007 | Huang | B21L 21/00 29/243.53 |
| 7,409,817 | B1 * | 8/2008 | Huang | B21L 21/00 29/243.53 |
| 7,797,920 | B2 * | 9/2010 | Wang | B21L 9/065 59/7 |
| 8,117,819 | B2 | 2/2012 | Scott | |
| 2010/0307126 | A1 * | 12/2010 | Seiter | B21L 21/00 59/7 |
| 2011/0179761 | A1 * | 7/2011 | Yu | B21L 9/065 59/7 |

* cited by examiner

*Primary Examiner* — Matthew P Travers

(74) *Attorney, Agent, or Firm* — Muncy, Geissler, Olds & Lowe, P.C.

(57) ABSTRACT

A chain replacement apparatus includes a body seat, an operation assembly, and a repair block. The operation assembly is rotatably disposed on the body seat. The repair block is disposed on the body seat and selectively switched among a removing status, a combining status, and a riveting status, so as to, through the operation assembly, break the chain, press the outer and inner chain plates, and rivet the chain. The repair block rotates about an action axis to be switched among different statuses.

10 Claims, 12 Drawing Sheets

CHAIN REPLACEMENT APPARATUS

BACKGROUND OF THE INVENTION

1. Field of the Invention

The present invention relates to maintenance apparatuses, and more particularly, to a chain replacement apparatus.

2. Description of the Related Art

A chain is usually applied as the power transmission device for vehicles. After a long period of moving on the bumpy road surface, the chain is often loosened or tightened. As a result, the chain will be disassembled or broken, so as to hinder the movement of the vehicle. It is necessary to adjust the tightness (tension) of the chain periodically.

For facilitating the maintenance and replacement of the chain, a chain repair device is applied. As shown by US20110016843A1, the device comprises a tool body, a PBR (pressing, breaking, riveting) block, and a plurality of repair blocks. By placing the PBR block at different positions of the tool body with cooperation of different repair blocks, the user is able to break the chain, press the inner and outer chain plates, and rivet the chain.

However, the PBR block, repair blocks, and the tool body are separated, instead of normally connected together. Therefore, when the user wishes to conduct different operations, the user needs to precisely combine the PBR block at different positions of the tool body and select different repair blocks corresponding to the operations. When the PBR block is placed at an incorrect position, or the repair blocks are incorrectly selected, the operation is unable to be carried out. As a result, the complicated combinations of the repair device cause the difficulties of the chain repairing and replacement operations.

SUMMARY OF THE INVENTION

For resolving the issues above, a chain replacement apparatus is disclosed. By rotating the repair block disposed on the body seat, the user is allowed to apply the operation assembly on the body seat to break the chain, press the inner and outer chain plates of the chain, and rivet the chain, so as to easily and efficiently conduct the chain repairing or replacement operations.

A chain replacement apparatus in accordance with an embodiment of the present invention comprises:

a body seat having an inner lateral face, with a first protrusion portion and a second protrusion portion disposed on two sides of the inner lateral face, respectively, a combination bore passing through the first protrusion portion, the combination bore defining an operation axis, the inner lateral face comprising a housing portion, the housing portion defining an action axis, the operation axis and the action axis being arranged in perpendicular;

an operation assembly rotatably passing through the combination bore along the operation axis; and a repair block rotatably disposed on the body seat and slidable with respect to the action axis, the repair block selectively being in a removing status, a combining status, and a riveting status, so as to alternatively provide a chain breaking, chain plate pressing, and chain riveting operation through the operation assembly; the repair block comprising a connection portion connected with the housing portion, the repair block being switchable between a first position and a second position; when the repair block is at the first position, the repair block is positioned on the body seat; when the repair block slides from the first position to the second position along the action axis, the repair block rotates about the action axis to be switched among the removing status, combination status, and the riveting status.

With such configuration, when different chain repairing and replacement operations are to be carried out, the user is allowed to rotate the repair block on the body seat, so as to conduct the chain repairing or replacement operations by means of the operation assembly of the body seat. Therefore, the inconvenience of assembling different components of the conventional device is resolved, achieving easy and efficient chain repairing and replacement operations.

DETAILED DESCRIPTION OF THE INVENTION

Figure 1:
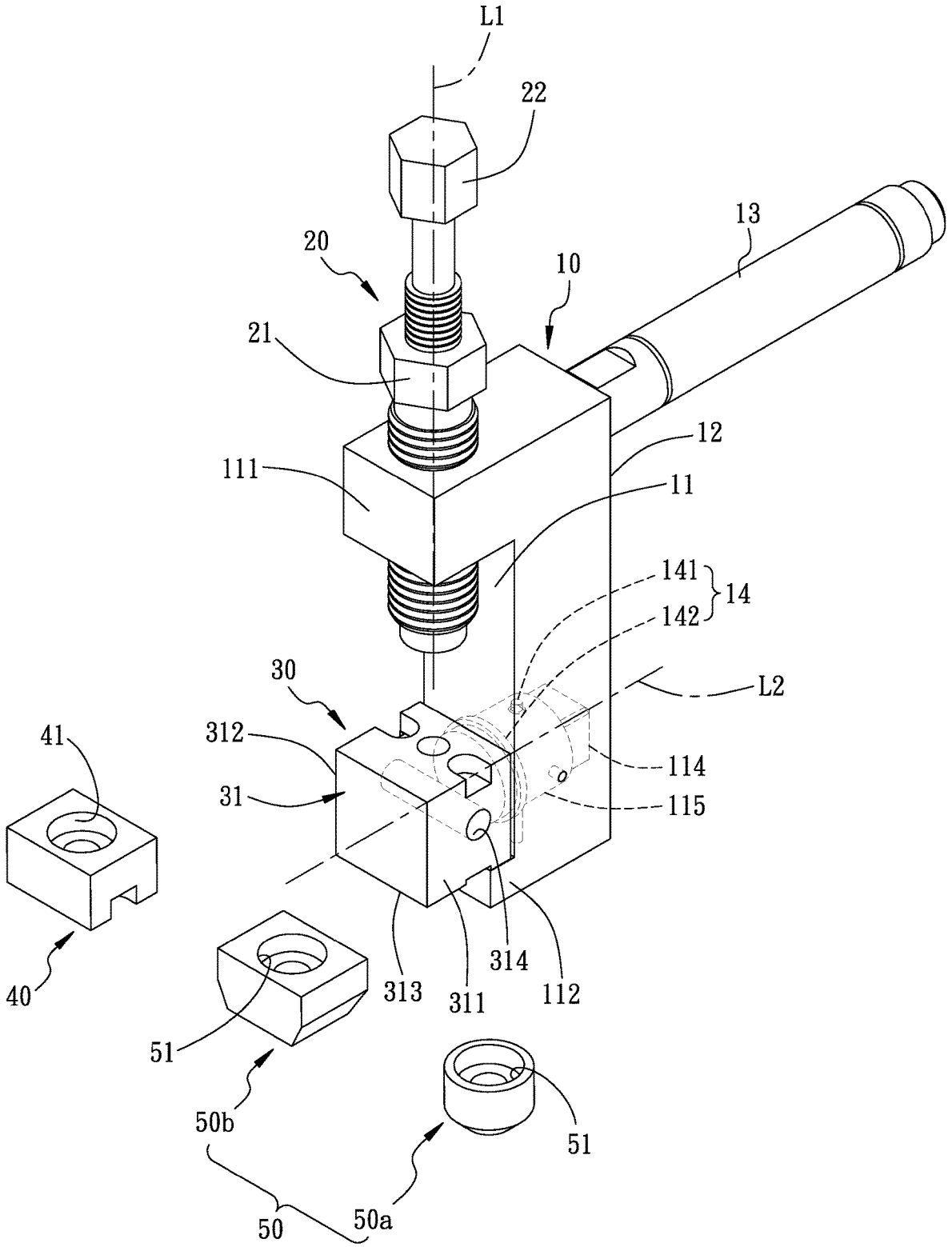
FIG. 1 is a perspective view of the chain replacement apparatus in accordance with an embodiment of the present invention.

The aforementioned and further advantages and features of the present invention will be understood by reference to the description of the preferred embodiment in conjunction with the accompanying drawings where the components are illustrated based on a proportion for explanation but not subject to the actual component proportion.

Referring to FIG. 1 to FIG. 12, a chain replacement apparatus is applied for breaking a chain 1, pressing an inner chain plate 2 and an outer chain plate 3 of the chain 1, and riveting the chain 1. The chain replacement apparatus comprises a body seat 10, an operation assembly 20, a repair block 30, a chain pressing block 40, and a pin pressing block 50.

Figure 2:
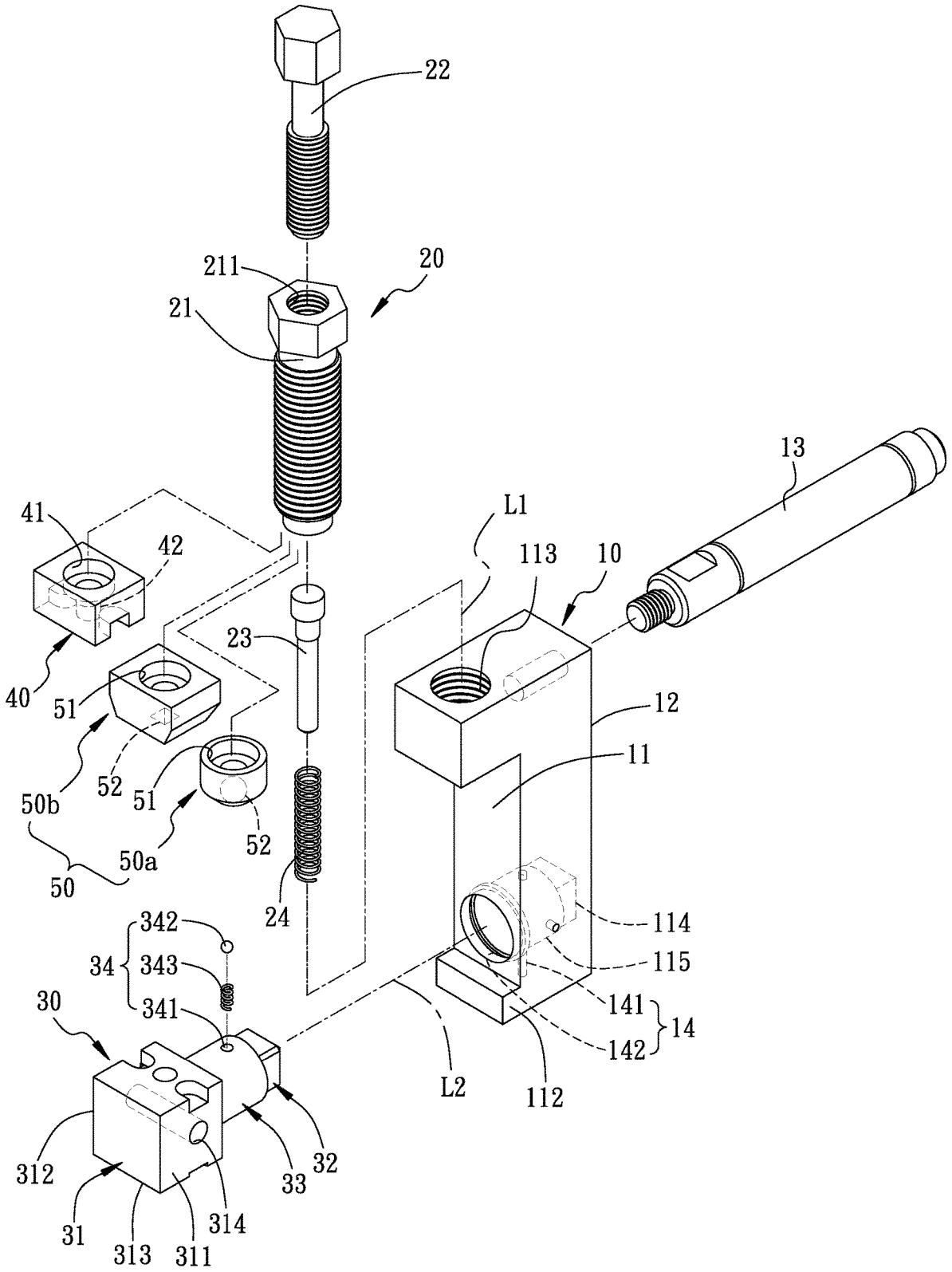
FIG. 2 is an exploded view of the chain replacement apparatus in accordance with an embodiment of the present invention.
Figure 3:
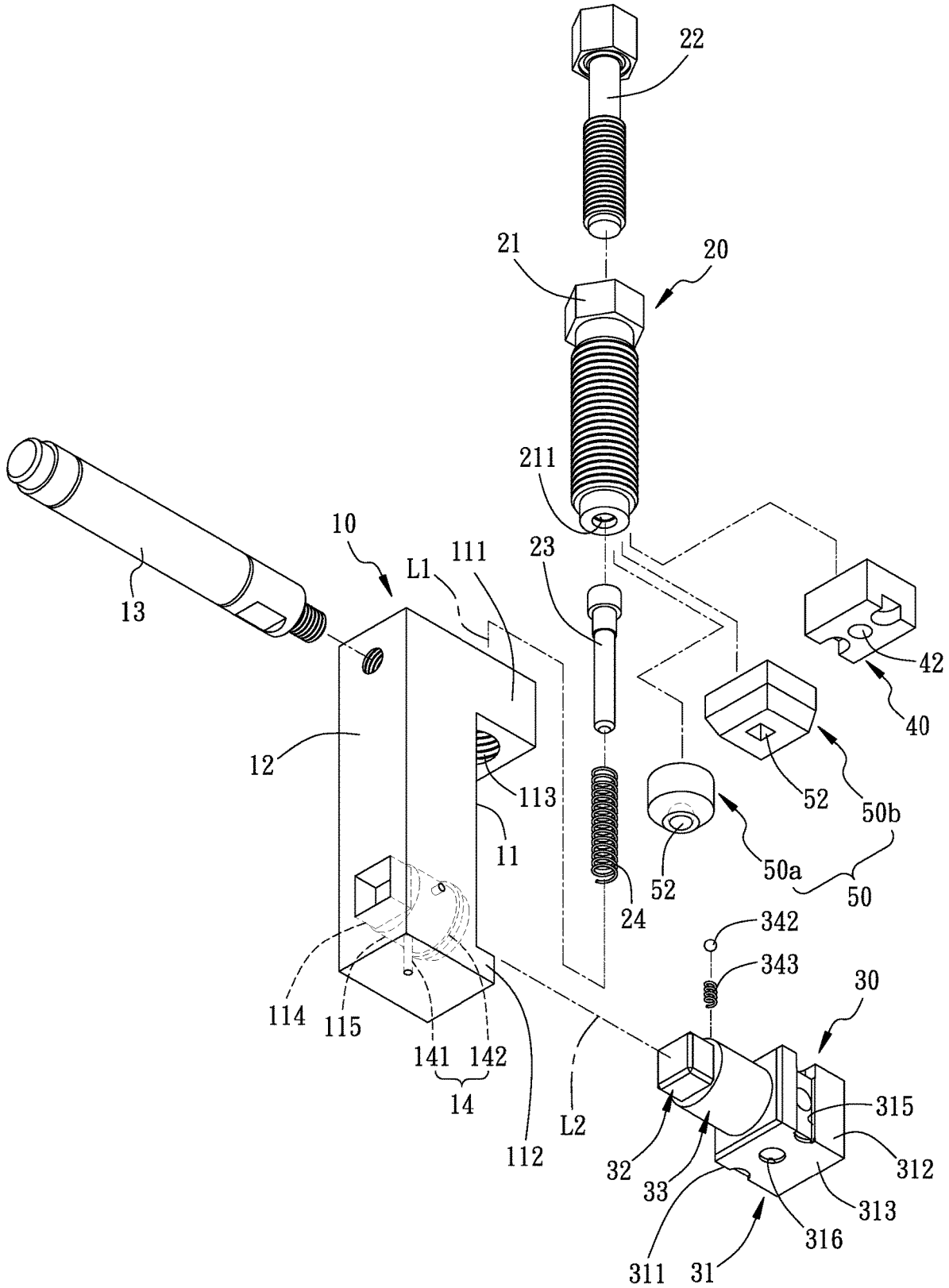
FIG. 3 is another exploded view of the chain replacement apparatus.

The body seat 10 is formed in a rectangular cuboid and comprises an inner lateral face 11 and an outer lateral face 12. A first protrusion portion 111 and a second protrusion portion 112 are disposed on two sides of the inner lateral face 11, respectively (upper side and lower side of the inner lateral face 11 as shown in FIG. 2). A handle 13 is screwed to the outer lateral face 12, allowing the user to grip the handle 13 for stabilizing the body seat 10 or holding the body seat 10.

The first protrusion portion 111 has a combination bore 113 passing therethrough. The combination bore 113 defines an operation axis L1. In an embodiment of the present invention, the combination bore 113 is a threaded bore. The inner lateral face 11 comprises a housing portion, which defines an action axis L2. The operation axis L1 is perpendicular to the action axis L2. In the embodiment of the present invention, the housing portion is concavely formed on the inner lateral face 11 in adjacent to the second protrusion portion 112. Therein, the housing portion comprises a first housing portion 114 formed in a rectangular cuboid shape and a second housing portion 115 formed in a circular column shape. The second housing portion 115 is closer to the inner lateral face 11 compared with the first housing portion 114.

The second housing portion 115 comprises a positioning structure 14 therein. The positioning structure 14 comprises a plurality of positioning bores 141 and a recess 142. The positioning bores 141 are concavely disposed in intervals on an inner periphery of the second housing portion 115. The recess 142 is concavely disposed on the inner periphery of the second housing portion 115, and is closer to the inner lateral face 11 than the positioning bores 141. In the embodiment of the present invention, four positioning bores 141 are provided. The positioning bores 141 are concavely disposed on the inner periphery of the second housing portion 115 in an equiangular arrangement, wherein the angle between two neighboring positioning bores 141 is 90 degrees.

The operation assembly 20 is rotatably disposed in the combination bore 113 of the first protrusion portion 111 along the operation axis L1. The operation assembly 20 comprises a first control member 21, a second control member 22, a chain breaking member 23, and a spring 24. An outer periphery of the first control member 21 is provided with an outer thread for being screwed to the combination bore 113. The first control member 21 has an through hole 211 passing therethrough. The through hole 211 comprises a stage therein, with the inner periphery of the through hole 211 provided with a thread. The second control member 22 is screwed to the threaded section of the through hole 211. The chain breaking member 23 is disposed at the non-threaded section of the through hole 211. A bottom end of the second control member 22 resists against the chain breaking member 23. Two ends of the spring 24 resist between the chain breaking member 23 and the stage in the through hole 211. Therein, when the user controls the first control member 21 to rotate with respect to the body seat 10, the operation assembly 20 moves along the operation axis L1. When the user controls the second control member 22 to rotate in one direction with respect to the first control member 21, the bottom end of the second control member 22 pushes the chain breaking member 23, such that the chain breaking member 23 gradually protrudes out of the through hole 211 and moves toward the second protrusion portion 112. When the user controls the second control member 22 to rotate in another direction, the bottom end of the second control member 22 gradually moves away from the chain breaking member 23, such that the resilient force of the spring 24 forces the chain breaking member 23 to be gradually contracted into the through hole 211.

The repair block 30 is rotatably disposed on the body seat 10, and slidable with respect to the action axis L2. The repair block 30 is able to selectively be in a removing status, a combining status, and a riveting status, so as to alternatively provide chain 1 breaking, inner chain plate 2 and outer chain plate 3 pressing, and chain 1 riveting operations through the operation assembly 20. The repair block 30 comprises a chain positioning portion 31 and a connection portion. The chain positioning portion 31 is arranged in alignment with the operation assembly 20, and the connection portion is received in the housing portion. The connection portion comprises a first connection portion 32 and a second connection portion 33. The second connection portion 33 is disposed between the first connection portion 32 and the chain positioning portion 31. The first connection portion 32 is formed in a cuboid shape corresponding to the shape of the first housing portion 114. The second connection portion 33 is formed in a circular column shape corresponding to the shape of the second housing portion 115.

The repair block 30 is switched between a first position and a second position. When the repair block 30 is at the first position, the repair block 30 is positioned on the body seat 10, wherein the cuboid-shaped first connection portion 32 and the first housing portion 114 prevent the rotation of the repair block 30. When the repair block 30 slides from the first position along the action axis L2 to the second position, the repair block 30 is forced to rotate about the action axis L2. Therefore, the repair block 30 is selectively switched among a removing status, a combining status, and a riveting status.

The chain positioning portion 31 comprises a pin removing surface 311, a pressing surface 312, and a riveting surface 313. When the repair block 30 is in the removing status, the pin removing surface 311 faces the operation assembly 20. When the repair block 30 is in the combining status, the pressing surface 312 faces the operation assembly 20. When the repair block 30 is in the riveting status, the riveting surface 313 faces the operation assembly 20. In the embodiment, the chain positioning portion 31 is formed in a cuboid shape, with the pin removing surface 311 facing the pressing surface 312, and the riveting surface 313 combined between the pin removing surface 311 and the pressing surface 312.

Figure 5:
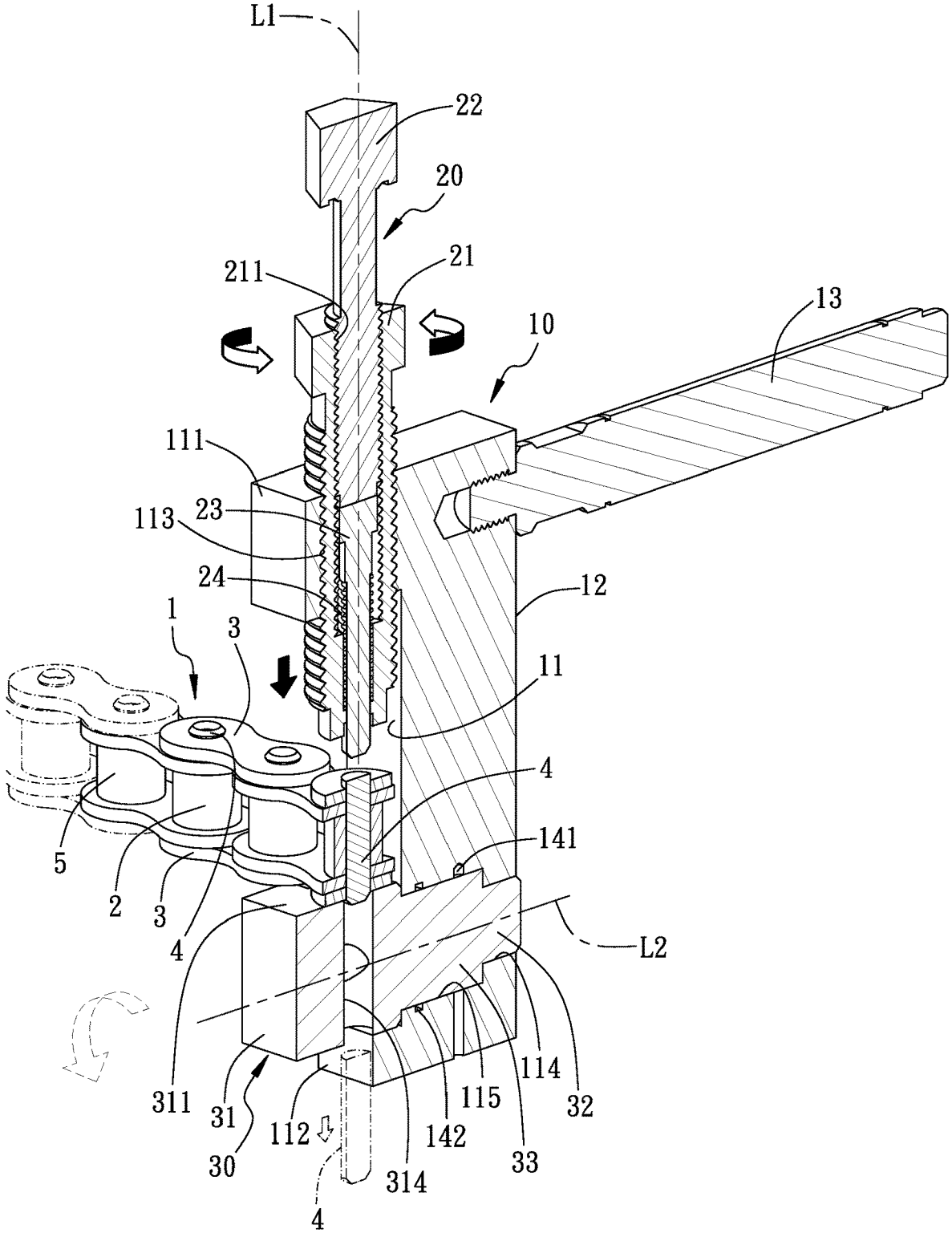
FIG. 5 is a perspective sectional view illustrating the operation status of the chain breaking operation.
Figure 6:
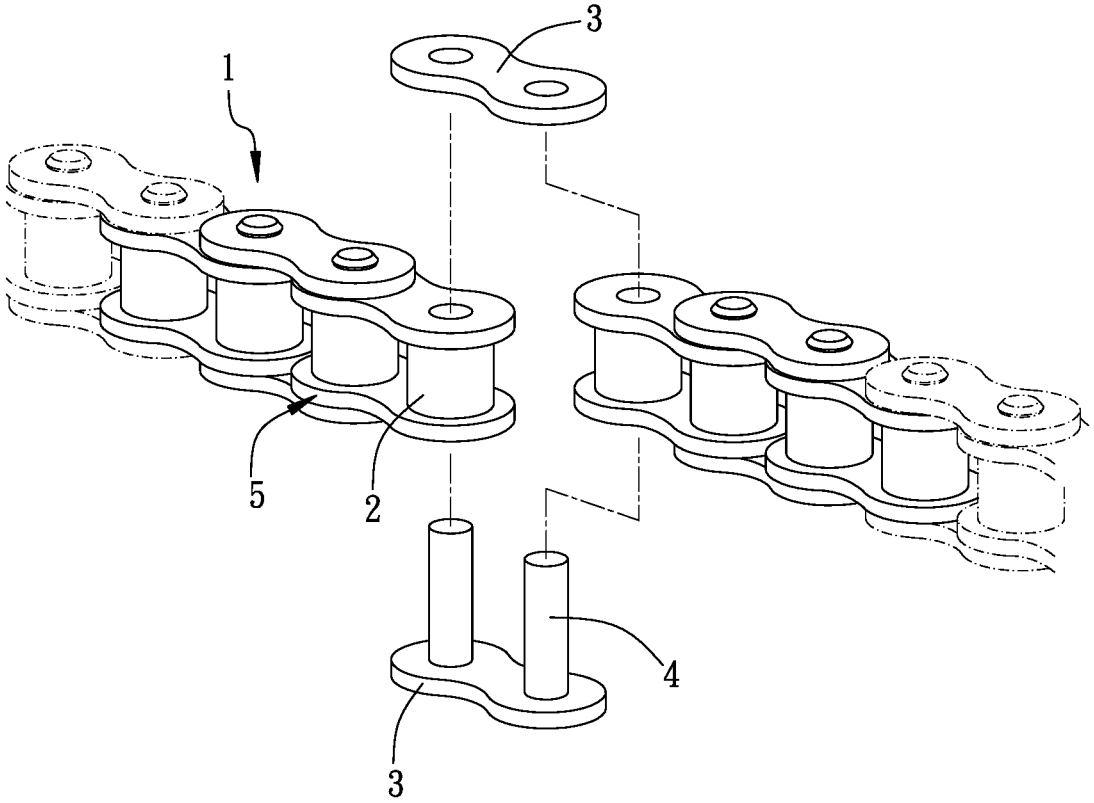
FIG. 6 is a schematic view illustrating the connection of two chain segments through the pin and the outer chain plate.
Figure 7:
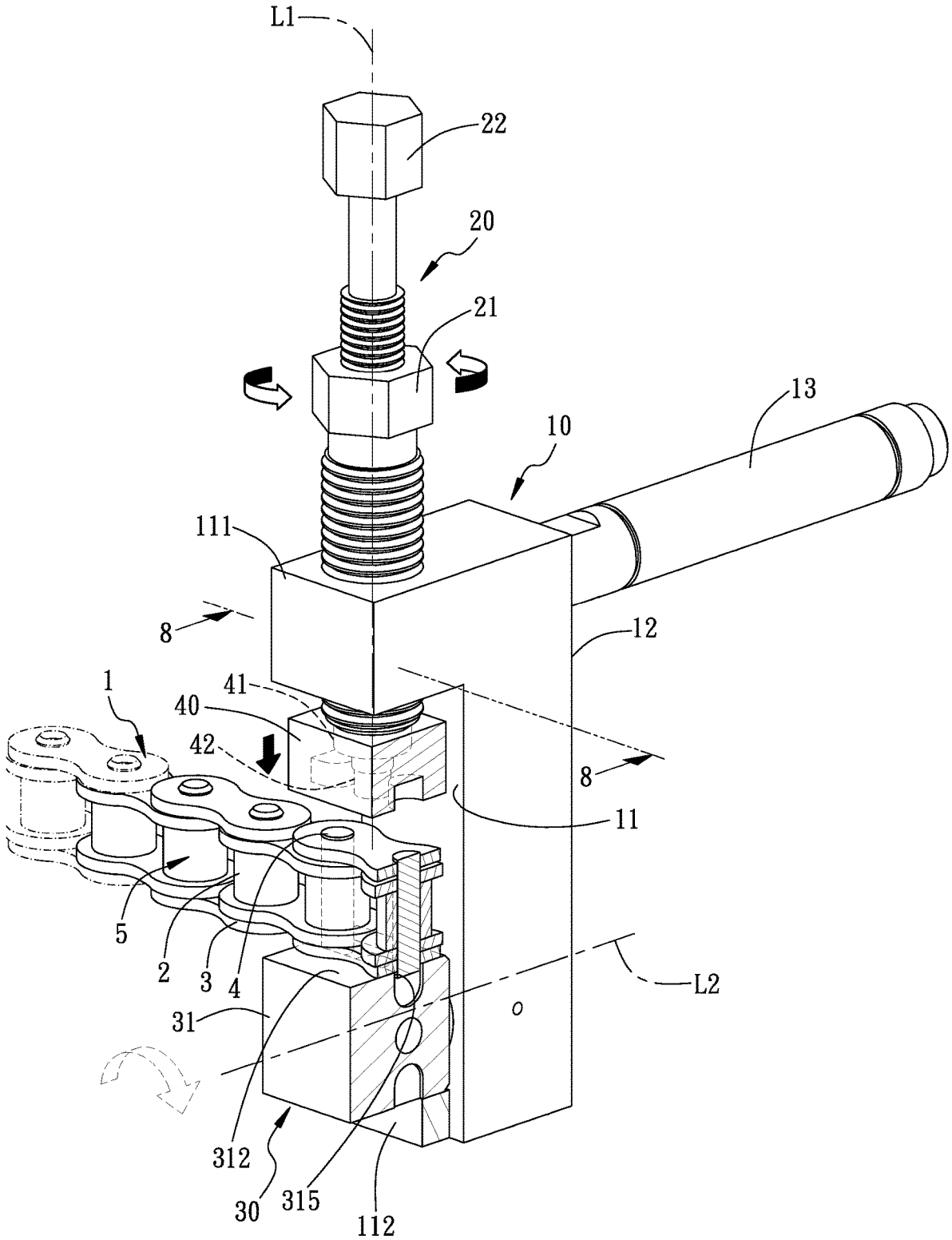
FIG. 7 is a perspective sectional view illustrating the operation status of pressing the inner and outer chain plates of the chain.
Figure 8:
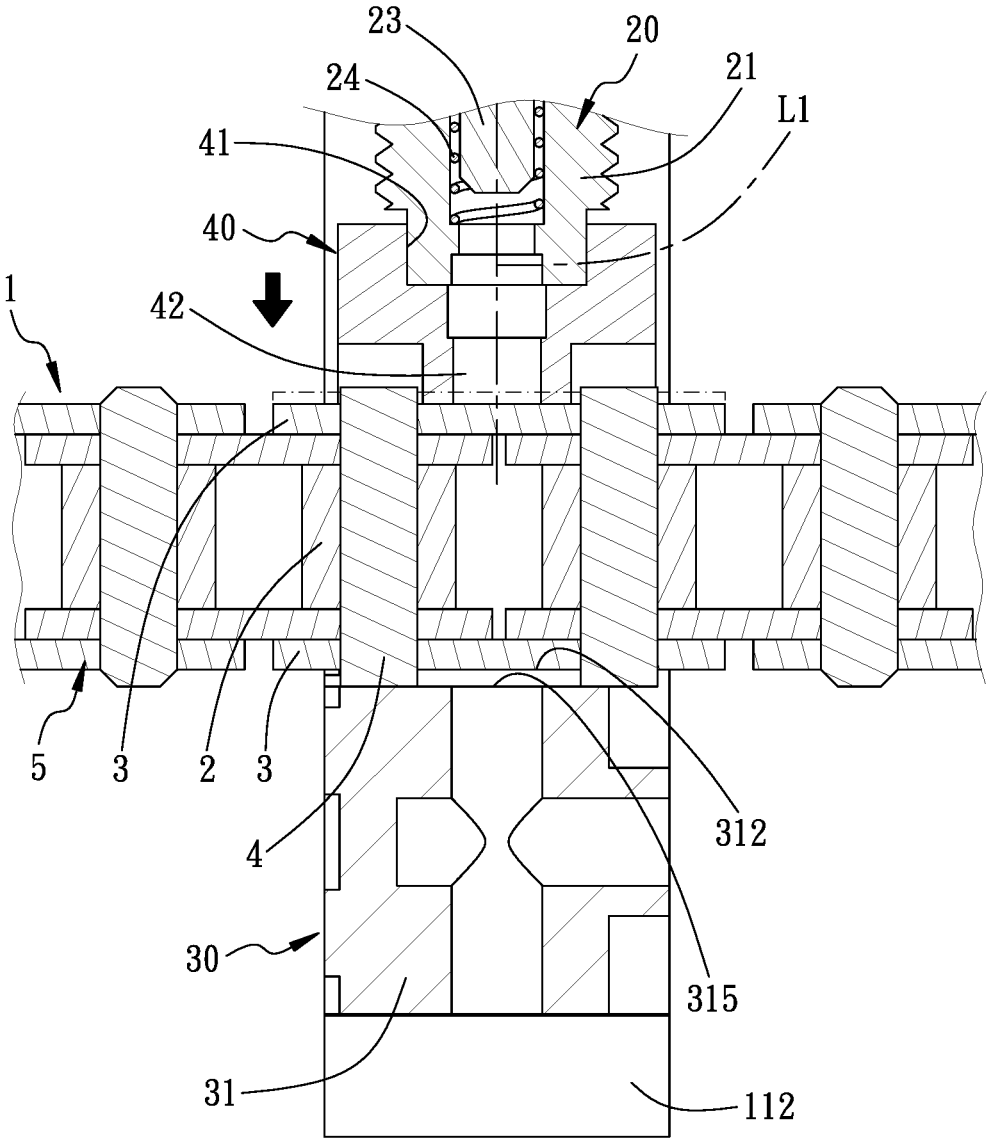
FIG. 8 is a cross-sectional view taken along line 8-8 in FIG. 7, illustrating the pressing operation of the inner and outer chain plates of the chain.

Also, referring to FIG. 5, the pin removing surface 311 has a tunnel 314 passing therethrough. During the chain 1 breaking operation, the tunnel 314 is applied for receiving a removed pin 4. Referring to FIG. 6 to FIG. 8, the pressing surface 312 comprises a concave positioning groove 315. When a chain segment 5 of the chain 1 is placed on the pressing surface 312, one outer chain plate 3 of the chain segment 5 is supported on two sides of the positioning groove 315, and the pin 4 is placed in the positioning groove 315. Referring to FIG. 9 to FIG. 12, the riveting surface 313 comprises a concave supporting recess 316. When one chain segment 5 of the chain 1 is placed on the riveting surface 313, the pin 4 has one end received in the supporting recess 316.

The second connection portion 33 comprises an engagement structure 34 which is matched with the positioning structure 14. The engagement structure 34 comprises a cave 341, a detent 342, and a recovering member 343. The cave 341 is concavely disposed on the second connection portion 33. Two ends of the recovering member 343 resist against a bottom of the cave 341 and the detent 342, respectively. When the repair block 30 is in the removing status, combining status, or the riveting status, the detent 342 is placed in one of the positioning bores 141. When the repair block 30 slides from the first position along the action axis L2 to the second position, the detent 342 moves into the recess 142, such that the repair block 30 is allowed to rotate about the action axis L2, so as to be switched among the removing status, combining status, and the riveting status.

The chain pressing block 40 comprises a first sleeve bore 41 and a resisting portion 42. The chain pressing block 40 is mounted on one end of the first control member 21 through the first sleeve bore 41, with the resisting portion 42 facing the repair block 30. When the first control member 21 drives the chain pressing block 40 to move, the resisting portion 42 of the chain pressing block 40 combines the outer chain plates 3 with the pin 4 and two inner chain plates 2 of the chain segment 5.

The pin pressing block 50 comprises a second sleeve bore 51 and a rivet portion 52. The pin pressing block 50 is mounted on one end of the first control member 21 through the second sleeve bore 51, with the rivet portion 52 facing the repair block 30. In the embodiment, the pin pressing block 50 comprises a first pin pressing block 50*a* and a second pin pressing block 50*b*. The rivet portion 52 of the first pin pressing block 50*a* is formed in a spherical shape, and the rivet portion 52 of the second pin pressing block 50*b* is a cone-shaped bore. The first control member 21 drives the pin pressing block 50 to move, such that the rivet portion 52 of the pin pressing block 50 presses one end of the pin 4, so as to finish the riveting operation.

Figure 4:
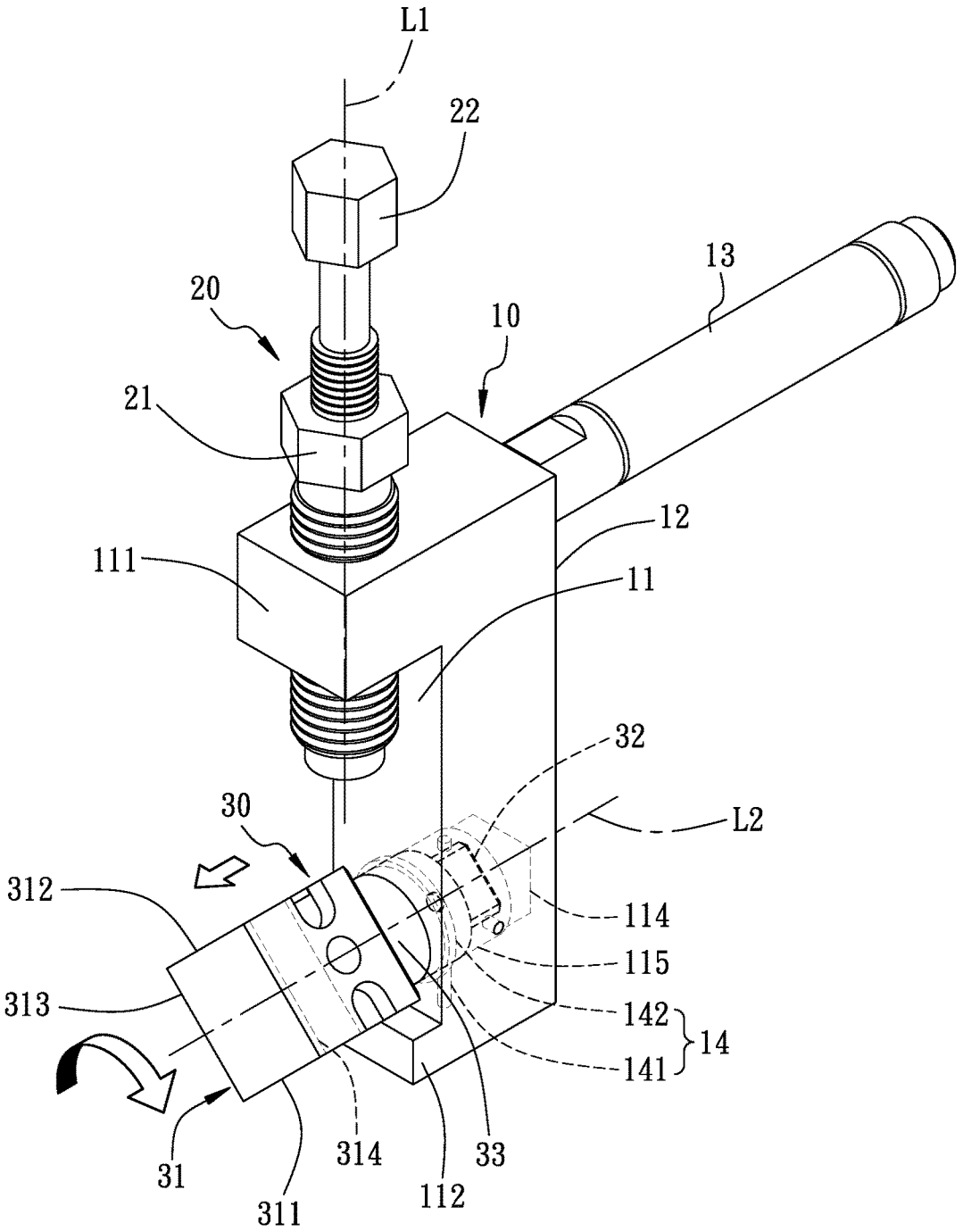
FIG. 4 is a schematic view of the repair block in accordance with an embodiment of the present invention.

Referring to FIG. 4, when the user grips the repair block 30 and imposes an external force to pull the repair block 30 to slide from the first position along the action axis L2 to the second position (i.e., to move away from the body seat 10), the first connection portion 32 of the repair block 30 leaves the first housing portion 114 of the body seat 10, and the detent 342 of the engagement structure 34 moves to the recess 142 of the positioning structure 14. Then, when the repair block 30 is at the second position, the user is able to grip the repair block 30 for rotating the repair block 30 about the action axis L2, thereby switching the repair block 30 among the removing status, combining status, and the riveting status. Finally, when the user rotates the repair block 30 to the status providing the target function, the user then slides the repair block 30 from the second position along the action axis L2 to the first position, such that the first connection portion 32 of the repair block 30 is matched with the first housing portion 114 of the body seat 10 again, with the detent 342 moving to be received in one of the positioning bores 141. Therefore, the repair block 30 is positioned at one of the removing status, combining status, and the riveting position.

Referring to FIG. 5, when two chain segments 5 of the chain 1 are to be broken, the user pulls and rotates the repair block 30, so as to make the pin removing surface 311 of the repair block 30 face the operation assembly 20, whereby the repair block 30 is in the removing status. Then, the user rotates the second control member 22 to push the chain breaking member 23 with the bottom end of the second control member 22, whereby the chain breaking member 23 protrudes out of the through hole 211 of the first control member 21 to push the pin 4 between the two chain segments 5 to the tunnel 314. As a result, the pin 4 is removed from the two chain segments 5, and the chain segments 5 of the chain 1 are broken.

Referring to FIG. 6, when the two chain segments 5 are to be connected through a pin 4, the user combines the outer chain plate 3 provided with two pins 4 with the inner chain plate 2 of the two chain segments 5, so that the two pins 4 are inserted in the inner chain plate 2 of the two chain segments 5, respectively, with one end of each pin 4 protruding from the inner chain plate 2 of the two chain segments 5. Afterward, the outer chain plates 3 are connected with the pins 4. Next, referring to FIG. 7 to FIG. 8, the user assembles the chain pressing block 40 on the first control member 21, then pulls and rotates the repair block 30, so as to make the pressing surface 312 of the repair block 30 face the operation assembly 20. The previously combined chain 1 is placed on the pressing surface 312, with the outer chain plate 3 provided with the two pins 4 resisting against two sides of the positioning groove 315, and the pins 4 placed in the positioning groove 315 of the pressing surface 312. Next, the user rotates the first control member 21, so that the first control member 21 drives the chain pressing block 40 to move toward the two chain segments 5, so as to compress the two outer chain plates 3, the two pins 4, and the inner chain plate 2 of the two chain segments 5 together. Therefore, the combination between the inner chain plate 2 and the outer chain plates 3 of the chain 1 is complete, facilitating the combination of the two chain segments 5.

Figure 9:
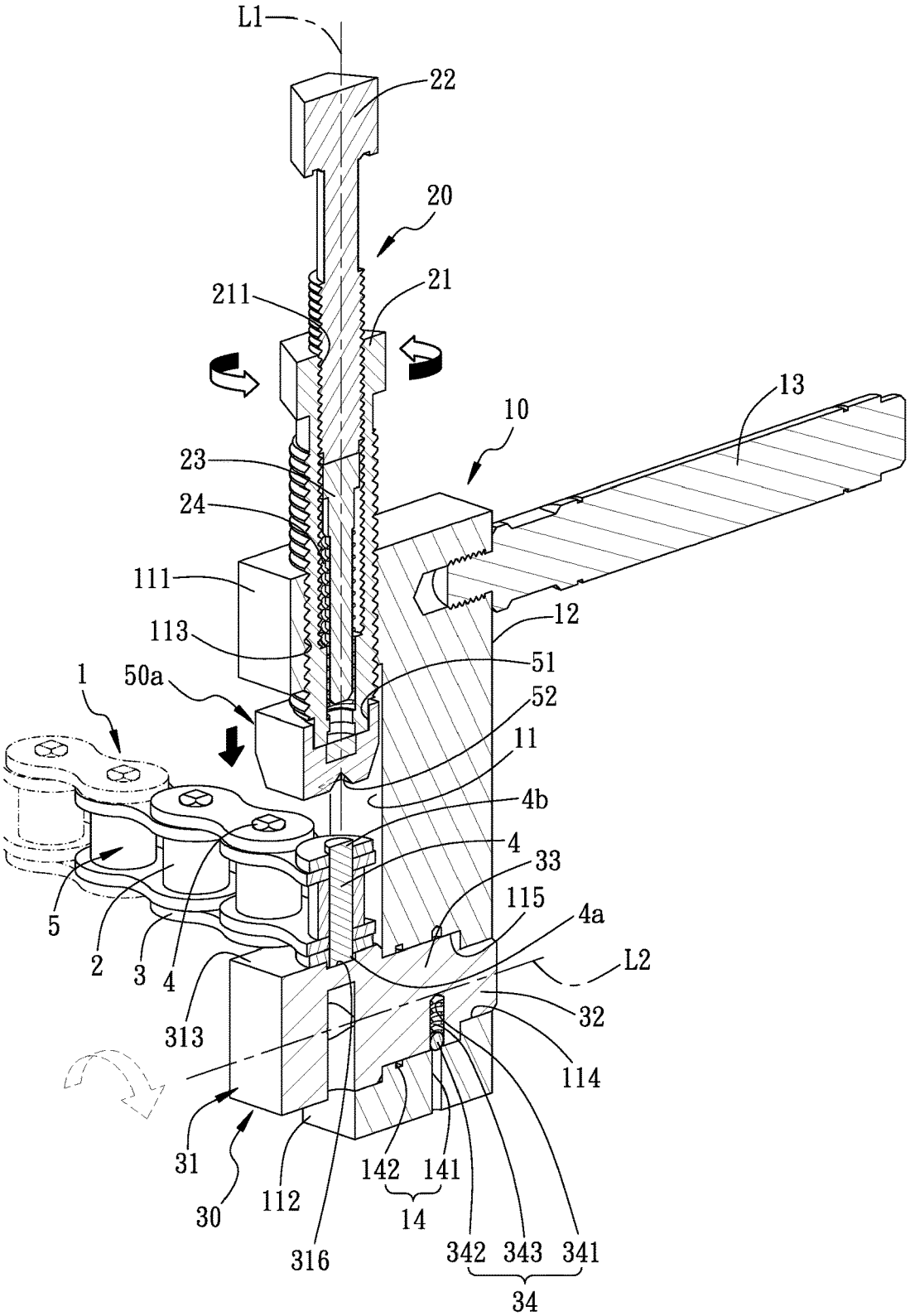
FIG. 9 is a perspective sectional view of the operation status of the chain riveting operation, illustrating the rivet portion of the pin pressing block formed in a cone shape.
Figure 10:
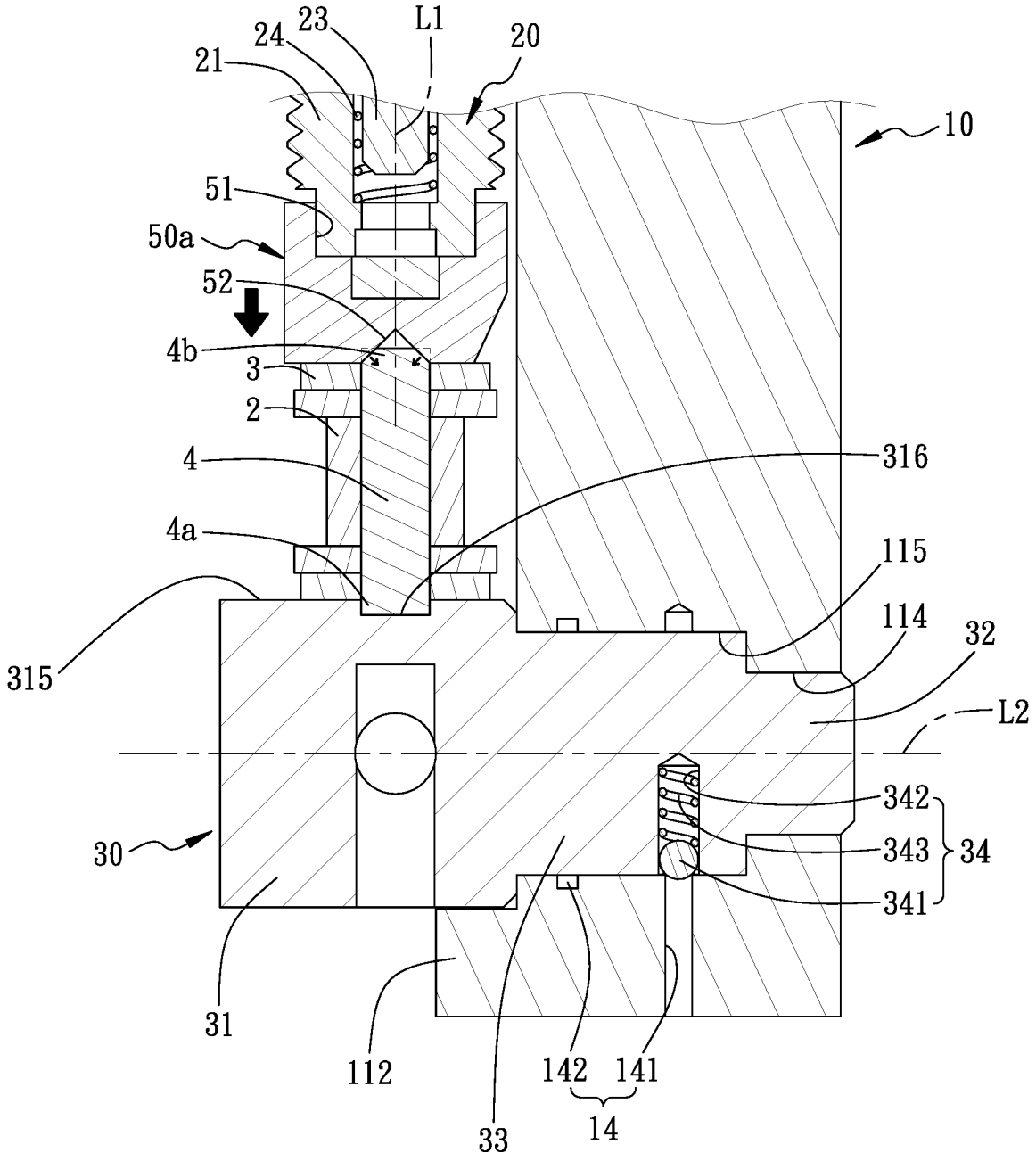
FIG. 10 is a sectional schematic view of the operation status of the chain riveting operation, illustrating the cone-shaped rivet portion resisting against an end portion of the pin.

Referring to FIG. 9 to FIG. 10, when a new combination of the two chain segments 5 is complete, and when the pins 4 are formed in a solid structure, for further stably combining the two pins 4 between the two chain segments 5, the user assembles the pin pressing block 50 on the first control member 21, and then pulls and rotates the repair block 30 to make the riveting surface 313 of the repair block 30 face the operation assembly 20. Afterward, the combined chain 1 is placed on the riveting surface 313, with one end portion 4*a* of one of the two pins 4 placed in the supporting recess 316. Next, the user rotates the first control member 21, such that the first control member 21 drives the pin pressing block 50 to move toward an end portion 4*b* of the pin 4, with the rivet portion 52 of the pin pressing block 50 pressing the end portion 4*b* of the pin 4, whereby the end portion 4*b* of the pin 4 is shaped in the shape of the rivet portion 52. After the shaping of the end portion 4*b* of the pin 4, the end portion 4*a* of the pin 4 is also allowed to be shaped with the same process. Therefore, the pin 4 is stably combined on the chain segment 5.

Figure 11:
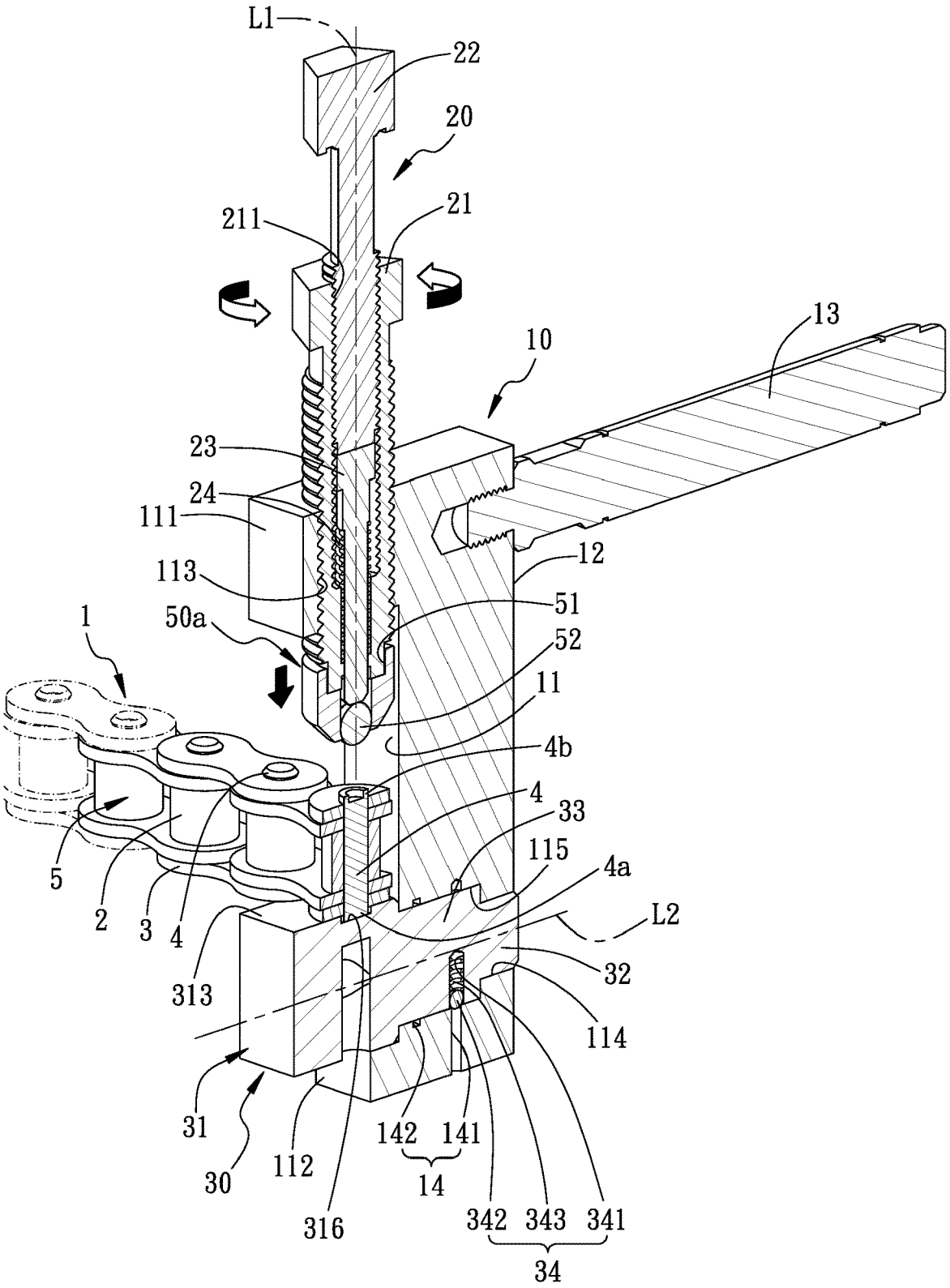
FIG. 11 is another perspective sectional view of the operation status of the chain riveting operation, illustrating the rivet portion of the pin pressing block formed in a spherical shape.
Figure 12:
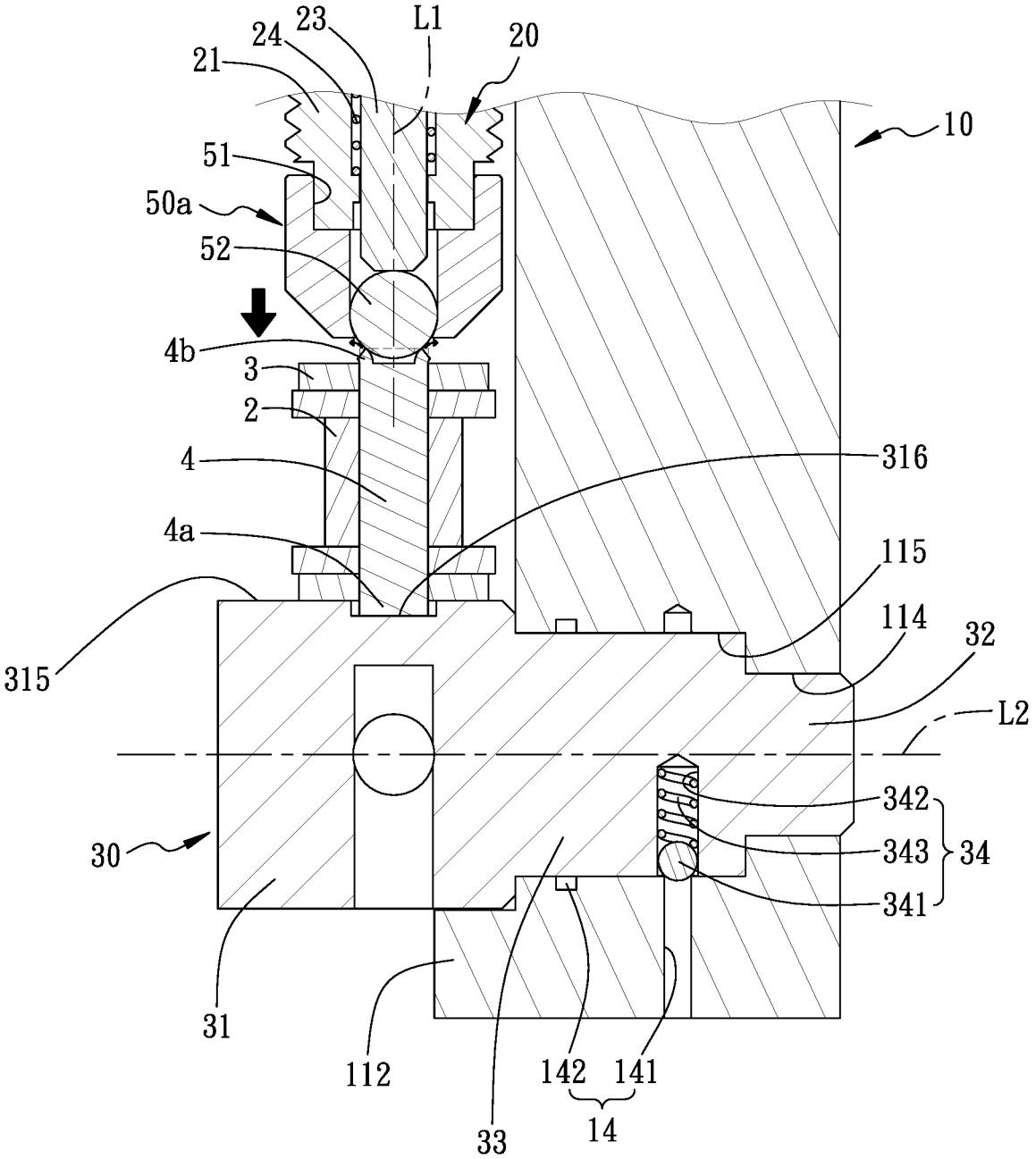
FIG. 12 is another sectional schematic view of the operation status of the chain riveting operation, illustrating the sphere-shaped rivet portion resisting against an end portion of the pin.

Referring to FIG. 11 to FIG. 12, when a new combination of the two chain segments 5 is complete, and when the pins 4 have one end thereof formed in a hollow structure, for further stably combining the two pins 4 between the two chain segments 5, the user assembles the pin pressing block 50 on the first control member 21, and then pulls and rotates the repair block 30 to make the riveting surface 313 of the repair block 30 face the operation assembly 20. Afterward, the combined chain 1 is placed on the riveting surface 313, with one end portion 4*a* of one of the two pins 4 placed in the supporting recess 316. Next, the user rotates the first control member 21, such that the first control member 21 drives the pin pressing block 50 to move toward the end portion 4*b* of the pin 4, with the rivet portion 52 of the pin pressing block 50 pressing the end portion 4*b* of the pin 4, whereby the end portion 4*b* of the pin 4 is shaped in an expanded recess. In other words, the end portion 4*b* of the pin 4 is expanded into a bore shape through the sphere-shaped rivet portion 52. Next, regarding the end portion 4*a* which is formed in a solid column structure, the user rotates the chain 1 and makes the end portion 4*a* of the pin 4, which is originally received in the supporting recess 316, face the operation assembly 20, and further combines the second pin pressing block 50*b* with the first control member 21, then subsequently presses the end portion 4*a* of the pin 4 with the rivet portion 52 of the second pin pressing block 50*b*, whereby the end portion 4*a* of the pin 4 is shaped into a cone shape, and the opening of the pin 4 is sealed. Another pin 4 is allowed to be shaped with the same process. Therefore, the pins 4 are stably combined on the chain segment 5.

With the foregoing configuration, the user is allowed to rotate the repair block 30 on the body seat 10 and assemble the chain pressing block 40 or the pin pressing block 50 according to the maintenance or replacement demands, so as to operate the operation assembly 20 on the body seat 10 for chain 1 breaking, inner chain plates 2 and outer chain plates 3 pressing, and chain 1 riveting operations. Therefore, a simple and efficient chain 1 maintenance and replacement operation is achieved.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A chain replacement apparatus, comprising:

a body seat having an inner lateral face, with a first protrusion portion and a second protrusion portion disposed on two sides of the inner lateral face, respectively, a combination bore passing through the first protrusion portion, the combination bore defining an operation axis, the inner lateral face comprising a housing portion, the housing portion defining an action axis, the operation axis and the action axis being arranged in perpendicular;

an operation assembly rotatably passing through the combination bore along the operation axis; and a repair block rotatably disposed on the body seat and slidable with respect to the action axis, the repair block selectively positionable into a removing status, a combining status, and a riveting status, so as to alternatively break a chain, press inner and outer chain plates of the chain, and rivet the chain through the operation assembly, the repair block comprising a connection portion connected with the housing portion, the repair block switchable between a first position and a second position; when the repair block is at the first position, the repair block is positioned on the body seat; when the repair block slides from the first position to the second position along the action axis, the repair block rotates about the action axis to be switched among the removing status, combining status, and the riveting status.

2. The chain replacement apparatus of claim 1, wherein the repair block comprises a chain positioning portion, the chain positioning portion comprising a pin removing surface, a pressing surface, and a riveting surface; when the repair block is in the removing status, the pin removing surface faces the operation assembly; when the repair block is in the combining status, the pressing surface faces the operation assembly; when the repair block is in the riveting status, the riveting surface faces the operation assembly.

3. The chain replacement apparatus of claim 2, wherein the operation assembly comprises a first control member, and the first control member is screwedly combined with the combination bore; when the repair block is in the combining status or the riveting status, the first control member is rotated with respect to the body seat, so as to drive the operation assembly to move along the operation axis for pressing the inner and outer chain plates or rivet a pin.

4. The chain replacement apparatus of claim 3, wherein the operation assembly comprises a second control member and a chain breaking member; a through hole passes through the first control member; the second control member is screwedly combined with the through hole; the chain breaking member is disposed in the through hole, with one end of the second control member resisting against the chain breaking member; when the repair block is in the removing status, the second control member rotates with respect to the first control member, so as to push the chain breaking member out of the through hole, so that the chain breaking member removes a pin of a chain segment.

5. The chain replacement apparatus of claim 4, wherein a tunnel passes through the pin removing surface; when the repair block is in the removing status, the pin removing surface faces the operation assembly, and the second control member rotates to push the chain breaking member out of the through hole, such that the chain breaking member removes the pin of the chain segment.

6. The chain replacement apparatus of claim 3, further comprising a chain pressing block having a first sleeve bore and a resisting portion; the chain pressing block is mounted on one end of the first control member through the first sleeve bore, and the resisting portion faces the repair block; a positioning groove is concavely disposed on the pressing surface; when the chain segment is placed on the pressing surface, an outer chain plate of the chain segment resists against two sides of the positioning groove, with the pin placed in the positioning groove, and the first control member rotates with respect to the body seat for driving the resisting portion to combine another outer chain plate of the segment with the pin and two inner chain plates.

7. The chain replacement apparatus of claim 3, further comprising a pin pressing block; the pin pressing block comprises a second sleeve bore and a rivet portion; the pin pressing block is mounted on one end of the first control member through the second sleeve bore, with the rivet portion facing the repair block; a supporting recess is concavely disposed on the riveting surface; when the chain segment is placed on the riveting surface, one end of the pin is positioned in the supporting recess, and the first control member rotates with respect to the body seat, so as to drive the rivet portion to push another end of the pin for shaping the pin into a shape of the rivet portion.

8. The chain replacement apparatus of claim 7, wherein the rivet portion is formed in a spherical shape or a cone shape.

9. The chain replacement apparatus of claim 1, wherein the housing portion comprises a positioning structure therein; the positioning structure comprises a plurality of positioning bores and a recess; the positioning bores are disposed in intervals on an inner periphery of the housing portion; the recess is concavely disposed on the inner periphery of the housing portion, and is closer to the inner lateral face than the positioning bores; the connection portion comprises an engagement structure, and the engagement structure is matched with the positioning structure; the engagement structure comprises a cave, a detent, and a recovering member, with the cave disposed on the connection portion, and two ends of the recovering member resisting a bottom of the cave and the detent; when the repair block is in the removing status, the combining status, or the riveting status, the detent is positioned in one of the positioning bores; when the repair block slides from the first position along the action axis to the second position, the detent is positioned in the recess, such that the repair block rotates about the action axis for being switched among the removing status, combining status, and riveting status.

10. The chain replacement apparatus of claim 9, wherein the repair block comprises a chain positioning portion connected with the connection portion; the connection portion comprises a first connection portion and a second connection portion, with the second connection portion disposed between the first connection portion and the chain positioning portion; the first connection portion is formed in a cuboid shape, and the second connection portion is formed in a circular column shape; the housing portion comprises a first housing portion and a second housing portion; the first housing portion is formed in a cuboid shape corresponding to the shape of the first connection portion, and the second housing portion is formed in a circular column portion corresponding to the shape of the second connection portion; each of the positioning bores and the recess are disposed in the second housing portion; when the repair block is at the first position, the first connection portion is matched with the first housing portion; when the repair block is at the second position, the first connection portion leaves the first housing portion.

* * * * *